US009533236B2

(12) United States Patent
Brunner

(10) Patent No.: US 9,533,236 B2
(45) Date of Patent: Jan. 3, 2017

(54) RING TOSS GAME

(76) Inventor: Henry Brunner, Carrollton, TX (US)

( * ) Notice: Subject to any disclaimer, the term of this patent is extended or adjusted under 35 U.S.C. 154(b) by 799 days.

(21) Appl. No.: 13/227,859

(22) Filed: Sep. 8, 2011

(65) Prior Publication Data

US 2013/0062830 A1 Mar. 14, 2013

(51) Int. Cl.

| | |
|---|---|
| ***A63B 67/06*** | (2006.01) |
| ***A63H 33/18*** | (2006.01) |
| ***A63F 9/02*** | (2006.01) |
| *A63F 3/00* | (2006.01) |

(52) U.S. Cl.

CPC ..... *A63H 33/18* (2013.01); *A63F 9/0204* (2013.01); *A63B 67/06* (2013.01); *A63F 2003/00757* (2013.01); *A63F 2009/0213* (2013.01); *A63F 2009/0286* (2013.01)

(58) Field of Classification Search

CPC ..... A63B 67/06; A63B 2208/12; A63B 63/00; A63B 2067/063

USPC ..... 273/393, 398–402

See application file for complete search history.

(56) References Cited

U.S. PATENT DOCUMENTS

| | | | | |
|---|---|---|---|---|
| 970,901 | A * | 9/1910 | Ernst | 273/393 |
| 1,970,249 | A * | 8/1934 | Prisciantelli | 273/393 |
| 3,231,278 | A * | 1/1966 | Bonlanger | 273/118 A |
| 4,203,592 | A | 5/1980 | Quatkemeyer | |
| 4,204,682 | A | 5/1980 | Brown | |
| 4,936,590 | A | 6/1990 | Palmer | |
| 4,989,880 | A | 2/1991 | Gettemeier et al. | |
| 5,040,801 | A * | 8/1991 | Weymuth | 273/338 |
| 5,060,955 | A * | 10/1991 | Bible | 273/400 |
| 5,067,730 | A * | 11/1991 | Wanalista | 473/468 |
| 5,125,669 | A * | 6/1992 | Kanda | 273/348 |
| 5,882,010 | A * | 3/1999 | Geror | 273/400 |
| 6,173,957 | B1 | 1/2001 | James, Sr. | |
| 6,341,780 | B1 | 1/2002 | Pant et al. | |
| 6,669,200 | B1 | 12/2003 | Knetsch et al. | |
| 6,749,201 | B2 * | 6/2004 | Kessler et al. | 273/400 |
| 6,899,336 | B2 * | 5/2005 | Michelet et al. | 273/400 |
| 6,923,448 | B2 * | 8/2005 | Fairbanks | 273/400 |
| 7,314,420 | B2 * | 1/2008 | Konstant | 473/594 |
| 7,360,767 | B2 * | 4/2008 | Merccica | 273/350 |
| 7,935,010 | B2 * | 5/2011 | Cerpok | 473/470 |
| 2003/0184013 | A1 * | 10/2003 | Chodosh | 273/139 |
| 2005/0051968 | A1 * | 3/2005 | Froesel | 273/336 |
| 2006/0066055 | A1 * | 3/2006 | Menendez | 273/398 |
| 2009/0200742 | A1 * | 8/2009 | Maietta | 273/401 |

* cited by examiner

*Primary Examiner* — Mark Graham

(74) *Attorney, Agent, or Firm* — Chainey P. Singleton; Chalker Flores, LLP

(57) ABSTRACT

A disc toss game that comprises a ball placed in the center of a ring that can be knocked out of the ring to score points, with additional points and bonuses being awarded if the disc stays within the ring is disclosed in various embodiments of the present invention. The game of the present invention comprises a plurality of parts and can be adapted for indoor as well as outdoor enjoyment.

5 Claims, 3 Drawing Sheets

RING TOSS GAME

CROSS-REFERENCE TO RELATED APPLICATIONS

None.

TECHNICAL FIELD OF THE INVENTION

The present invention relates in general to the field of pitching games, specifically to a pitch game utilizing disc-type throwing projectiles thrown at a ball within a scoring ring to position the disc-type throwing projectiles according to the skill of the thrower.

STATEMENT OF FEDERALLY FUNDED RESEARCH

None.

REFERENCE TO A SEQUENCE LISTING

None.

INCORPORATION-BY-REFERENCE OF MATERIALS FILED ON COMPACT DISC

None.

BACKGROUND OF THE INVENTION

Without limiting the scope of the invention, its background is described in connection with pitching and tossing games. For example, U.S. Pat. No. 4,936,590, entitled "Pitch Game," (hereinafter the '590 patent) discloses a portable pitch game that is a self -contained target/toss-type game having 2 multi apertured rectangular platforms. The '590 patent issued to Palmer (1990), comprises colored apertured disc projectiles supplied in sets of six, one set for each player. A player stands on the edge of one platform and tosses discs in an attempt drop them through one of the apertures in the second platform. The apertures are scored 1, 2, 3 according to distance away from the thrower. Separable hinges and latches are included for attaching the 2 rectangular platforms together into a storage or carrying case.

U.S. Pat. No. 4,989,880, entitled "Tossing Game Apparatus," issued to Gettemeier and Gettemeier (1991), (hereinafter the '880 patent) discloses an improved portable target assembly for toss type games having a cup shaped target member centrally located on one side of a flexible mat, the flexible mat having a centrally located portion with a plurality of peripheral edge portions around said center portion and extending outwardly therefrom, the edge portions being foldable and having end portions which are cooperatively engageable in a variety of ways to form alternative configurations of upstanding side walls for containing playing pieces tossed thereat so as to enable changing the degree of difficulty and skill level required to play the game, the cup shaped target member being detachable from the flexible mat and the mat being reliable into a cylindrical shape for convenient handling and storage. The present target assembly optionally including an open ended tubular container for holding one or more flexible mats and a plurality of playing pieces and the cup shaped target member being cooperatively engageable with one of the open ends to close the container, or alternatively, locatable in the container with the flexible mats and playing pieces.

Floyd (1980) in U.S. Pat. No. 4,204,682, entitled "Method and Apparatus for Outdoor Tossing Game," (hereinafter the '682 patent) discloses a method of playing a game and has a plurality of groups of distinguishably identified markers which are tossed from behind a throwing line at a receptacle in an attempt to put the marker in the receptacle. The receptacle is recessed into the ground or other playing surface and is approximately thirty feet to fifty feet away from the throwing line, which may be another receptacle. A protective cover may be provided to enclose the receptacle when not in use to avoid any accidents or the accumulation of contamination therein. The marker may be shaped as a disc or washer and may be sufficiently heavy to be substantially unaffected by all but the strongest wind during play.

A horseshoe type game device in which annular disks or rings are pitched or tossed at targets provided on each of 2 similar game mats is disclosed in U.S. Pat. No. 4,203,592, entitled "Horseshoe Type Game Device," (hereinafter the '592 patent) issued to Quatkemeyer (1980). Each game mat comprises a small piece of carpet-like material having a stake extending above it and disposed immediately behind a circular aperture of greater diameter than the annular disks or rings. The game mats are spaced by approximately 20 feet and the rings are tossed from behind one game mat toward the other game mat. Points are given according to the proximity of the ring to the aperture after the ring has landed. If a player is able to produce a "ringer" by having the ring land directly over the stake, he wins automatically. Otherwise, the first player to reach a given number of points in his point score is the winner.

U.S. Pat. No. 6,173,957, entitled "Tossing Game," (hereinafter the '957 patent) describes a tossing game including a plurality of moveable targets having an upward facing opening and a plurality of projectiles for being tossed for accuracy into the opening. The '957 patent issued to James (2001) comprises indicia on the projectiles that match respective indicia on the targets. The target may be constructed as a tube or similar shape. The target is inflatable for portability and flotation.

A disc tossing game is disclosed in U.S. Pat. No. 6,341,780, issued to Pant and Pant (2002), (hereinafter the '780 patent). The Pant invention includes a first board, a second board and a plurality of discs. The first board has three bores therein. The bores are generally aligned. The second board is substantially identical to the first board. Point indicia are located on the first and second boards and are adjacent to each of the bores. The indicia adjacent to a first outside bore indicating five points. The indicia adjacent to the middle bore indicating three points. The indicia adjacent to the second outside bore indicating one point. Multiple discs are used for tossing into the bores. Two players or two pairs of players may play.

Finally, U.S. Pat. No. 6,669,200, issued to Knetsch et al. (2003) (hereinafter the '200 patent) relates to a disc toss game which includes a target box or receiver with a false bottom interposed between the top and bottom edges, with the elevation of the false bottom being positionably adjustable relative to the plane of the top edges of the target box. A standpipe or tube is mounted within the target box coaxially with the center of the square target box. The target box has an outer perimeter defined by chamfered edges, with the plane of the top edge of the open standpipe or tube being positionably adjustable within the target box from an upper position which is coplanar with the edges of the target box, into one or more lower positions in which the top edge of the standpipe is recessed from the plane of the top edges of the target box.

SUMMARY OF THE INVENTION

The present invention describes a disc toss game entitled "King of the Rings." The present invention describes a method of playing a ring toss game by providing 2 metal rings, wherein each of the metal rings are held in place on a surface by one or more locating stakes; providing 2 balls, wherein one ball is placed at or about a center of each of the 2 metal rings. The ball may be positioned on a top surface of a tee to be placed at or about the center of the metal ring; providing at least one set of disc-type throwing projectiles, wherein each set of disc-type throwing projectiles comprise 2 metal discs. The metal discs are colored or marked with a suitable indicia for identification; providing at least 2 players; placing the 2 metal rings approximately 25 ft. from each other; allowing the player throwing the disc to be in a standing position behind the metal rings; tossing the disc in the direction of the metal rings, wherein each player can toss one or both of the discs; accumulating or scoring points by one or any combination of the following: Throwing the disc and knocking the ball out of the ring to score 5 points; throwing the disc and making it stay or lean inside the ring to score 5 points; throwing the disc and making it lean on the outside of the ring or balance on the edge of the ring to score 3 points; and the throwing the disc and having it land within 12" from the edge of the ring or the measurement of the size of the largest shoe, (being worn by any one of the players) to score 1 point; summing up the points scored to arrive at an accumulated score for each individual player; and determining a winner of the game by selecting the first player to accumulate or score 21 points.

The surface on which the metal rings are placed comprises a grass surface; an artificial turf; a sandy surface; a court comprising a vinyl edging; or any combination thereof. The court comprising a vinyl edging has a diameter of approximately 72". The metal ring is held in place by 2 locating stakes, wherein a first locating stake is placed on a front inside portion of the ring and a second locating stake is placed on a rear outside portion of the ring. The tee is a rubber-tipped tee. There are three sets of disc-type throwing projectiles. Each set of disc-type throwing projectiles may be colored, each with a different color and each set of disc-type throwing projectiles are numbered differently or comprise a specific and distinguishable indicia. The number of players range from 2-6 split into three teams of 2 players on each team, and each team receives a set of discs with a different color and a different numbering or indicia. In team play, only 1 player with the highest score in each team is used to determine the accumulated score. An individual may score a maximum of 15 points by throwing 2 discs into the ring while knocking the ball simultaneously out of the ring. The ring toss game can be played indoors or outdoors.

The present invention describes a method of playing an indoor ring toss game by providing 2 metal rings, wherein each of the metal rings are held in place, on a surface or mat, by one or more plastic position pins; providing 2 balls, wherein one ball is placed at or about the center of each of the metal rings. The ball may be positioned on a top surface of a rubber tee to be placed at or about center of the metal ring; providing at least one set of a disc-type throwing projectiles, wherein each set of disc-type throwing projectile comprise 2 rubber discs which are colored or marked with a suitable indicia for identification, providing at least 2 players; placing the 2 metal rings approximately 25 ft. from each other; allowing the player throwing the disc to be in a standing position behind the metal rings; tossing the disc in the direction of the metal rings, wherein each player can toss one or both of the discs; accumulating or scoring points by one or any combination of the following: Throwing the disc and knocking the ball out of the ring to score 5 points; throwing the disc and making it stay or lean inside the ring to score 5 points; throwing the disc and making it lean on the outside of the ring or balance on the edge of the ring to score 3 points; and throwing the disc and having it land within 12" of the edge of the ring or the measurement of the size of the largest shoe, (being worn by any one of the players) to score 1 point; summing up the points scored to arrive at an accumulated score for each individual player; and determining a winner of the game by selecting the first player to accumulate or score 21 points. The metal rings, the position pins, the balls, the rubber tees, the discs, or any combination thereof are enclosed in a carrying case.

The surface on which the metal rings are placed comprises a hardwood floor; a carpeted floor; an astro mat; a padded mat; a granite or stone floor; or any combination thereof. The metal ring is held in place by 2 position pins, wherein a first pin is placed on a front inside portion of the ring and a second pin is placed on a rear outside portion of the ring. There are three sets of disc-type throwing projectiles. Each set of disc-type throwing projectiles are each colored with a different color. Each set of disc-type throwing projectiles are each numbered differently or comprise a specific and distinguishable indicia. There may be 2-6 players. If there are 6 players in the game, the 6 players may be split into 3 teams having 2 players, on each team. Each team will receive a set of discs with a different color and a different numbering or indicia. In team play, the player with the highest score in each team is used to determine the accumulated score.

The present invention describes a method of playing an outdoor ring tossing game by providing 2 metal rings, wherein each of the metal rings are held in place on a surface by one or more locating stakes providing at least one set of a disc-type throwing projectiles, wherein each set of disc-type throwing projectiles comprise 2 metal discs. The discs are colored or marked with a suitable indicia for identification providing at least 2 players placing the 2 metal rings approximately 25 ft. from each other allowing the player throwing the disc to be in a standing position behind the metal rings tossing the disc in the direction of the metal rings, wherein each player can toss one or both of the discs accumulating or scoring points comprising one or any combination of the following: Throwing the disc and making it stay or lean on the inside ring to score 5 points throwing the disc and making it lean on the outside of the ring or balance on the edge of the ring to score 3 points; and throwing the disc and having it land within 12" of the edge of the ring or the measurement of the size of the largest shoe, (being worn by any one of the players) to score 1 point; summing up the points scored to arrive at an accumulated score for each individual player; and determining a winner of the game by selecting the first player to accumulate or score 21 points. The metal rings, the locating stakes, the discs, or any combination thereof are enclosed in a carrying case.

The surface on which the metal rings are placed comprises a grass surface; an artificial turf; a sandy surface; a court comprising a vinyl edging; or any combination thereof. The metal ring is held in place by 2 locating stakes, wherein a first locating stake is placed on a front inside portion of the ring and a second locating stake is placed on a rear outside portion of the ring. There are 3 sets of disc-type throwing projectiles. Each set of disc-type throwing projectiles are each colored with a different color and are numbered differently or comprise a specific and distinguishable indicia. The number of players range from 2-6. The 6 players may be split into 3 teams of 2 each, and each team receives a set of discs with a different color and a different numbering or indicia. In team play, the highest score of only 1 player in each team is used to determine the accumulated score. No points are awarded if opposing players or teams both throw discs that lean on the outside of the ring or balance on the edge of the ring.

The present invention describes another method of playing an indoor ring tossing game by providing 2 metal rings, wherein each of the metal rings are held in place on a surface or mat by 1 or more plastic positioning pins providing at least one set of disc-type throwing projectiles, wherein each set of disc-type throwing projectiles comprise 2 rubber or polymeric discs are colored or marked with a suitable indicia for identification providing at least 2 players placing the 2 metal rings approximately 25 ft. from each other allowing the player throwing the disc to be in a standing position behind the metal rings tossing the disc in a direction of the metal rings, wherein each player can toss one or both of the discs accumulating or scoring points. The steps of accumulating or scoring points comprises one or any combination of throwing the disc and making it stay or lean inside the ring to score 5 points throwing the disc and making it lean on the outside of the ring or balance on the edge of the ring to score 3 points; and throwing the disc and having it land within 12" of the edge of the ring or the measurement of the size of the largest shoe, (being worn by any one of the players) to score 1 point; summing up the points scored to arrive at an accumulated score for each individual player; and determining a winner of the game by selecting the first player to accumulate or score 21 points. The metal rings, the positioning pins, the balls, the rubber tees, the rubber discs, or any combination thereof are enclosed in a carrying case. The surface on which the metal rings are placed comprises a hardwood floor; a carpeted floor; an astro mat; a padded mat; a granite or stone floor; or any combination thereof. The number of sets of disc-type throwing projectiles are three, wherein each set of disc-type throwing projectiles are each colored with a different color and are numbered differently or comprises a specific and distinguishable indicia. The number of players may range from 2-6. The players may be split into three teams, each team having 2 players, and each team receiving a set of discs wherein each disc is a different color and wherein each disc has a different numbering or indicia. In team play, the highest score of only 1 player in each team is used to determine the accumulated score. No points are awarded if opposing players or teams both throw discs that lean on the outside of the ring or balance on the edge of the ring.

The present invention describes yet another method of playing a ball capture game by providing a play area, and a gaming kit comprising: At least one ball; at least 1 set of disc-type throwing projectiles, comprising 2 metal, polymeric or rubber discs. Each of the discs are colored or marked with a suitable indicia for identification. A tape measure or suitable distance measuring device is also provided. The ball is then thrown by 1 of the players participating in the game, allowing a first player to throw a disc in order to capture or get closest to the ball thrown in the play area. A second player then throws a disc to capture or get closest to the ball thrown in the play area. Any subsequent players throws a disc in order to capture or get closest to the ball thrown in the play area. The steps of throwing the discs are repeated until the attempt of the first player has been bested. Accumulating or scoring points by any combination of the following: Throwing the disc and capturing the ball by being close to the ball or landing on top of the ball in any manner to score 21 points; throwing the disc and hitting the ball to score 5 points; and throwing the disc and landing within 6 inches of the ball to score 5 points; throwing the disc and landing within 12 inches of the ball to score 3 points; throwing the disc and landing within 24 inches of the ball to score 1 point; summing up the points scored to arrive at an accumulated score for each individual player and determining a winner of the game by selecting the first player to accumulate or score 21 points. If the ball is on top of any part of the disc then 10 points are deducted from the score of a player. The game is adapted for indoor or outdoor play. The play area dimensions range from 20-30 ft. in width and 30-40 ft. in length. There are three sets of disc-type throwing projectiles. Each set of disc-type throwing projectiles are colored each with a different color and are numbered differently or comprises a specific and distinguishable indicia. A metal disc is used for outdoor play and a rubber or polymeric disc is used for indoor play. The number of players can range from 2-6.

A game kit for playing a ring toss game which includes a carrying case, one or more plastic position pins; at least 1 set of disc-type throwing projectiles, wherein each set of disc-type throwing projectiles comprise 2 metal, rubber, plastic, or polymeric discs wherein each disc is colored or marked with a suitable indicia for identification. The game kit may optionally include at least 2 balls, metal tees rubber-tipped, or rubber tees, wherein 1 ball is placed at or about the center of each of the metal rings by positioning on a top surface of the tee. The game kit can be adapted for indoor or outdoor play. The game kit can be adapted to play one or more versions of the ring toss game.

A first version of the ring toss game by providing at least 2 players placing the 2 metal rings approximately 25 ft. from each other allowing the player throwing the disc to be in a standing position behind the metal rings tossing the disc in a direction of the metal rings, wherein each player can toss one or both of the discs accumulating or scoring points wherein the steps of accumulating or scoring points comprises one or any combination of throwing the disc and knocking the ball out of the ring to score 5 points; throwing the disc and making it stay or lean inside the ring to score 5 points; throwing the disc and making it lean on the outside of the ring or balance on the edge of the ring to score 3 points; and throwing the disc and having it land within 12" of the edge of the ring or the measurement of the size of the largest shoe, (being worn by any one of the players) to score 1 point; summing up the points scored to arrive at an accumulated score for each individual player; and determining a winner of the game by selecting the first player to accumulate or score 21 points. Each player may score a maximum of 15 points by throwing 2 discs into the ring in an attempt at knocking the ball simultaneously out of the ring.

The second version of the ring toss game is played with at least 2 players placing the 2 metal rings approximately 25 ft. from each other allowing the player throwing the disc to be in a standing position behind the metal rings tossing the disc in a direction of the metal rings, wherein each player can toss one or both of the discs accumulating or scoring points wherein the steps of accumulating or scoring points comprises one or any combination of the following: Throwing the disc and making it stay or lean inside the ring to score 5 points throwing the disc and making it lean on the outside of the ring or balance on the edge of the ring to score 3 points; and throwing the disc and being within 12" of the edge of the ring or the measurement of the size of the largest shoe, (being worn by any one of the players) to score 1 point; summing up the points scored to arrive at an accumulated score for each individual player; and determining a winner of the game by selecting the first player to accumulate or score 21 points. No points are awarded if opposing players or teams both throw discs that lean on the outside of the ring or balances on the edge of the ring. The metal ring is held in place by 2 locating stakes or position pins, wherein a first locating stake or position pin is placed in the front inside portion of the ring and a second locating stake or position pin is placed on the rear outside portion of the ring. There are 3 sets of disc-type throwing projectiles. Each set of disc-type throwing projectiles may be colored with a different color and/or a specific and distinguishable indicia. In the event of team play, the score of the player with the highest score in each team is used to determine the accumulated score.

The present invention provides a game kit for playing a ball capture game by tossing rings that include at least 1 ball; and at least 1 set of disc-type throwing projectiles, wherein each set of disc-type throwing projectiles comprise 2 metal, polymeric or rubber discs which are colored or marked with a suitable indicia for identification. There are 3 sets of disc-type throwing projectiles. Each set of disc-type throwing projectiles are colored with a different color and are numbered differently or comprise a specific and distinguishable indicia.

The game kit includes a method for playing the ball capture game by tossing rings in a play area wherein dimensions range from 20-30 ft. in width and 30-40 ft. in length. The ball is thrown by 1 of the players participating in the game allowing a first player to throw a disc to capture or get closest to the ball thrown in the play area; allowing a second player to throw a disc to capture or get closest to the ball thrown in the play area; allowing any subsequent players to throw discs to capture or get closest to the ball thrown in the play area; repeating the steps of throwing the disc until the attempt of the first player has been bested; accumulating or scoring points comprising one or any combinations of the following: Throwing the disc and capturing the ball by being or landing on top of the ball in any manner to score 21 points throwing the disc and hitting the ball to score 5 points; and throwing the disc and landing within 6" of the ball to score 5 points; throwing the disc and landing within 12" of the ball to score 3 points; throwing the disc and landing within 24" of the ball to score 1 point; summing up the points scored to arrive at an accumulated score for each individual player determining a winner of the game by selecting the first player to accumulate or score 21 points. Ten points are deducted from the score of a player if the ball is on top of any part of the disc.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1A:
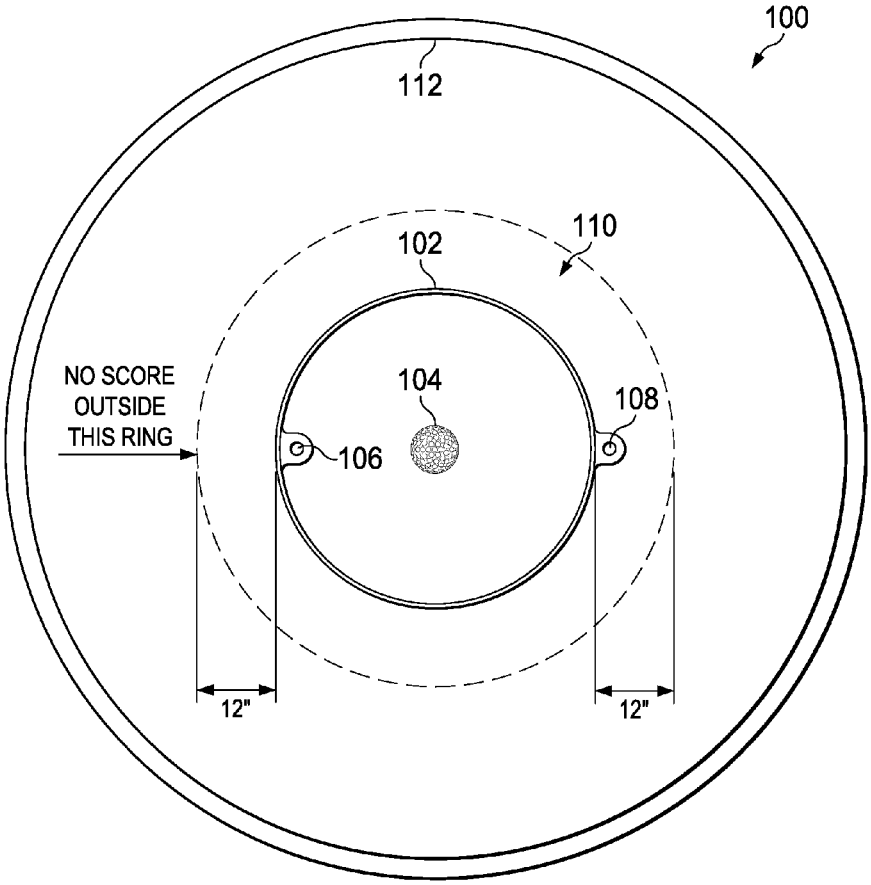
FIG. 1A is a schematic showing a top view of the set-up of the ring toss game according to an embodiment of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

The present invention describes a disc toss game entitled "King of Rings" that comprises a ball that is placed in the center of a ring that can be knocked out of the ring to score points, with additional points and bonuses being awarded if the disc stays within the ring.

The disc/ring toss game of the above invention is easier to play than horseshoes. Moreover, like horseshoes the parts comprising the ring toss game of the present invention lasts forever. An added advantage of the present invention is that the ring toss game can be adapted for indoor or outdoor play.

Furthermore, the ring toss game of the present invention encompasses three games within one. These games are listed herein below:

Game I is "Vanquished." The object of the game is to knock the ball out of the ring by throwing a disc and having the disc remain in the ring or be closest to the ring.

Game II is "Liberator." No ball is used in this game. The object of the game is to throw the disc inside the ring or be closest to the ring.

Game III is "Capture." No ring is used in this game. The object of the game is to throw the ball like Bocci Ball, then try to capture the ball with the disc or hit it for points. Leaning on the ball is a "Capture."

The design of the rules and the scoring patterns of the above three games are intended to provide unlimited enjoyment and fun to the players. The games are so designed that irrespective of how far behind a player gets during the course of a game the probability for victory always exists.

The different parts (components) involved in indoor/outdoor play are listed in Tables 1 and 2 below:

TABLE 1

Parts for Outdoor Play

| Part Name | Quantity |
|---|---|
| Carrying Case | 1 |
| Locating Stakes | 4 |
| Metal Tees Rubber-Tipped | 2 |
| Metal Rings | 2 |
| Balls | 2 |

TABLE 1-continued

| Parts for Outdoor Play | |
|---|---|
| Part Name | Quantity |
| Silver Disc No. 1 | 2 |
| Gold Disc No. 2 | 2 |
| Red Disc No. 3 | 2 |

The skilled artisan will know that the disk-type throwing projectiles and metal rings can be made of any material (i.e., wood, metal, plastic, rubber, etc.) and be any shape (disc, square, triangular, etc.) and have any indices/color (i.e., 1, 2, 3, 100, I, II, etc.). For example, the disc-type throwing projectiles may be (Gold Disc No. 2; Red Disc No. 3) or (Silver Hard Rubber No. 1 Disc; Gold Hard Rubber No. 2 Disc; or Red Hard Rubber No. 3 Disc).

TABLE 2

| Parts for Indoor Play | |
|---|---|
| Part Name | Quantity |
| Carrying Case | 1 |
| Plastic Position Pins | 2 |
| Rubber Tees | 2 |
| Metal Ring | 1 |
| Balls | 2 |
| Silver Hard Rubber No. 1 Disc | 2 |
| Gold Hard Rubber No. 2 Disc | 2 |
| Red Hard Rubber No. 3 Disc | 2 |
| Astro Mats | 2 |

Game I

Vanquished

Figure 2A:
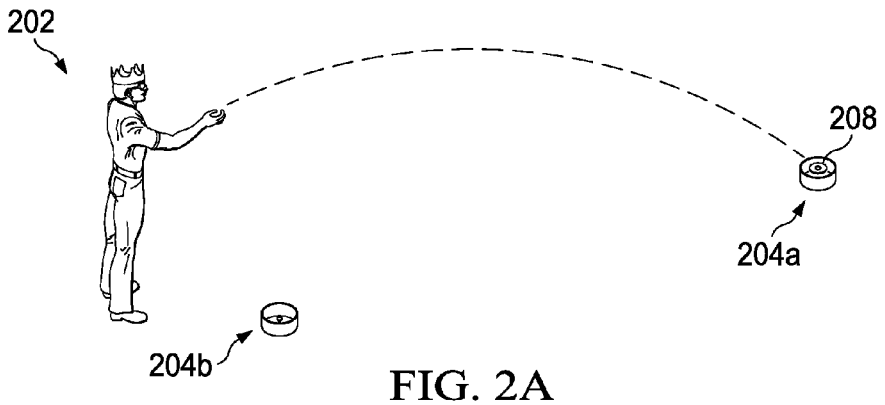
FIGS. 2A-2C are representations showing the different games a thrower can play within the ring toss game of the present invention: (2A) Liberated, (2B) Vanquished, and (2C) Capture.
Figure 2B:
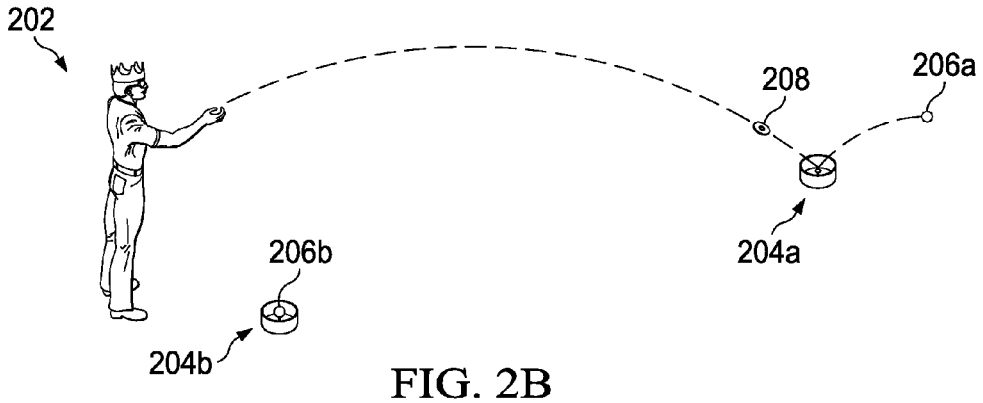

Object of the Game: To be the first player to score 21 points. A schematic representation of the game is shown in FIG. 2B.

Set-Up (for outside play, for 2-6 players): Two rings placed 25 ft. apart. Each ring is held in place with 2 long locating stakes. One locating stake is placed in the front inside of the ring and the other locating stake is placed on the rear outside of the ring.

Set-Up (for indoor play, for 2-6 players): The Astro mat is used for positioning the 2 rings. The plastic positioning pins are used instead of the locating stakes and the rubber tees are used instead of the metal tees rubber-tipped.

There are 2 balls, during game play, each player places 1 ball in the center of a ring on top of a tee. Two 12" rubber-tipped tees are included. Tees are optional and are used to center the ball and to raise the ball high enough to be seen above the grass where necessary. There are three sets of colored and numbered discs, there are 2 discs in each set. A carrying case may also be included. For tournament play a 72" diameter court of vinyl edging may be used.

Rules and Scoring for Each Player: The object of the game is to be the first player to score 21 points.

1. Points are scored:

By throwing the disc and knocking the ball out of the ring (5 pts.).

By throwing the disc wherein the disc stays or leans inside the ring (5 pts.).

By throwing the disc wherein the disc leans on the outside of the ring or balances on the edge of the ring (3 pts.).

By throwing the disc and having it land within 12" of the edge of the ring or the measurement of the largest player's shoe (1 pt.).

2. The player throwing the disc is to stand behind the ring.

3. The player with the lowest numbered disc starts the game.

4. Each player throws both of their discs during their turn at play.

5. After the first throw the player that scores last throws first.

6. Only 1 player's disc counts.

7. Knocking the ball out of the ring is a bonus and always counts (5 pts.).

8. When 2 players throw ringers or leaners, no points are scored for anyone except the bonus ball if knocked outside of the ring.

9. Throwing the disc and having it remain within the ring (5 pts.).

10. Throwing both of the player's discs inside of the ring, while knocking the ball outside of the ring (15 pts.).

Game II

Liberator

Object of the Game: To be the first player to score 21 points. A schematic representation of the game is shown in FIG. 2A.

Set-Up (for outside play, for 2-6 players): Two rings placed 25 ft. apart. Each ring is held in place with 2 long locating stakes.

Set-Up (for indoor play, for 2-6 players): The Astro mat is used for positioning the 2 rings. The plastic positioning pins are used instead of the locating stakes and the rubber tees are used instead of the metal tees rubber-tipped.

There are 3 sets of numbered discs (each set having 2 discs).

Rules and Scoring

1. The object of the game is to score 21 points to win.

2. The player with the lowest numbered disc starts the game

3. The player throwing their disc is to stand behind the ring.

4. Each player throws both of their discs during their turn at play.

5. Points are scored:

throwing the disc and having it stay or lean inside the ring (5 pts.).

throwing the disc and having it lean on the outside of the ring or balance on the edge of the ring (3 pts.).

by throwing a disc and being within 12" of the measurement of the largest players' shoe (1 pt.).

6. After the first set the player that scores last throws first.

7. Only 1 player's disc counts.

8. When 2 players each throw ringers or leaners no points are scored for anyone in that throw.

Game III

Capture

Figure 2C:
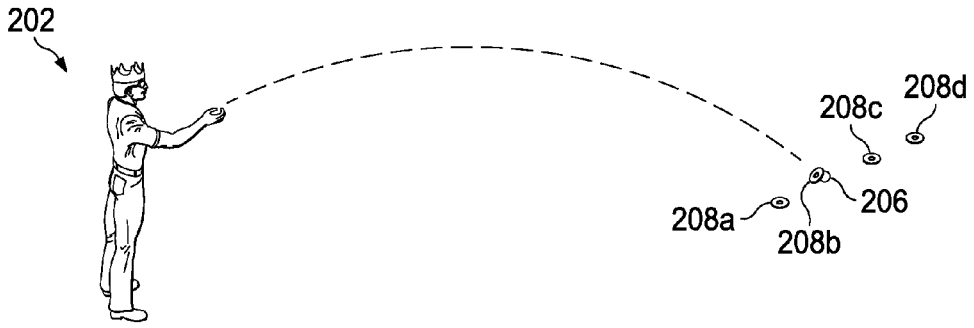

Object of the Game: To be the first to score 21 points. A schematic representation of the game is shown in FIG. 2C.

Set-Up (2-6 players): Area 20-30 ft. wide by 30-40 ft. long, having 1 ball, 3 sets of discs (2 discs in each set), and 1 tape measure.

Rules

1. The object of the game is to be the first player to score 21 points.

2. The starting player with the lowest numbered disc takes the ball and throws it to his desired distance.

3. The starting player then throws only one of his discs to the ball trying to capture the ball or getting as close as possible to the ball.

4. The next player throws his first disc to the ball trying to capture it or getting closer to the ball than the starting player.

5. The next player then does the same.

6. If no one has bested the first player's disc, the first player doesn't throw his next disc until his first disc was bested and so on.

7. After all throws are at one end, the player that scored last begins play again by throwing the ball and his first disc.

Scoring

1. Capturing the ball by being on top of it in any manner (21 pts.).

2. Hitting the ball (5 pts.).

3. Being within 6 inches of the ball (5 pts.).

4. Being within 12 inches of the ball (3 pts.).

5. Being within 24 inches of the ball (1 pt.).

6. If the ball captures a player by being on top of any part of the player's disc (−10 pts.).

FIG. 1A is a schematic 100 showing a top view of the set-up of the ring toss game according to an embodiment of the present invention. The set-up shows a ring 102 held in place with 2 long stakes 106 and 108. The first long stake 106 is placed in the front inside of the ring 102 and the second long stake 108 is placed on the rear outside of the ring 102. One ball 104 is placed in the center of the ring 102 on top of a tee (not shown herein). Tees are optional to center the ball and to raise the ball high enough to be seen above the grass/ground (not shown) where necessary. For tournament play a 72" diameter court ring 112 of vinyl edging may be used. The Ring 110 represents the area 12" around the edge of the ring 102 beyond which point there is no scoring.

Figure 1B:
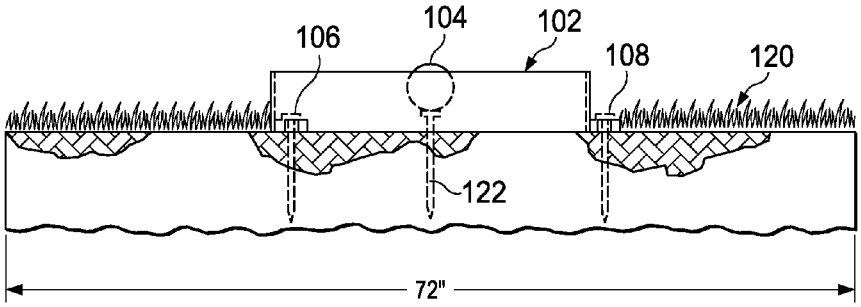
FIG. 1B is a schematic showing a side view of the ring used on grass.

FIG. 1B is a schematic showing a side view of the ring 102 used on the grass/ground 120. FIG. 1B shows a ring 102 held in place with 2 long stakes 106 and 108. Long stake 106 is placed in the front inside of the ring 102 and long stake 108 is placed on the rear outside of the ring 102. The ball 104 is placed in the center of the ring 102 on top of a tee 122. Tee 122 centers the ball 104 and raises the ball 104 high enough to be seen above the grass/ground 120 where necessary.

FIGS. 2A-2C are representations showing the different games a thrower 202 can play within the ring toss game of the present invention. FIG. 2A is a representation of Game II, "Liberator": No ball is used in this game. The object of the game is for the thrower 202 to throw the disc 208 into the ring 204 or be closest to the ring 204. FIG. 2B is a representation of Game I, "Vanquished": The object of the game is for the thrower 202 to knock the ball 206 out of the ring 204 by throwing a disc 208 and to have the disc 208 remain in the ring 204 or be closest to the ring 204. FIG. 2C is a representation of Game III,"Capture": No ring is used in this game. The object of the game is for the thrower 202 to throw the ball 206 (like Bocci Ball), then try to capture the ball 206 with any of the discs 208*a-d* or hit ball 206 for points. The disc 208*b* leaning on the ball 206 is called a "Capture."

Figure 3A:
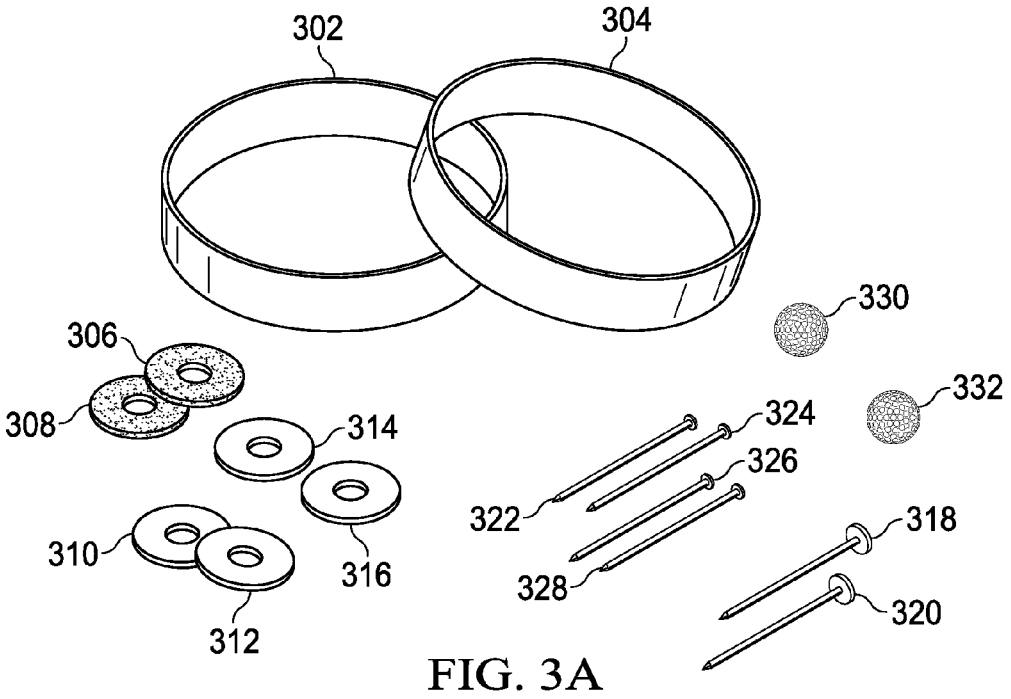
FIG. 3A is an illustration showing the different parts of the ring toss game of the present invention.

FIG. 3A is an illustration showing different parts of the ring toss game of the present invention. FIG. 3A shows 2 metal rings 302 and 304, 2 metal tees with rubber tips 318 and 320, four locating stakes 322, 324, 326, and 328. There are also 2 balls 330 and 332. The discs comprise 2 silver number 1 discs: 310 and 312, 2 gold number 2 discs: 314 and 316, and 2 red number 3 discs: 306 and 308.

Figure 3B:
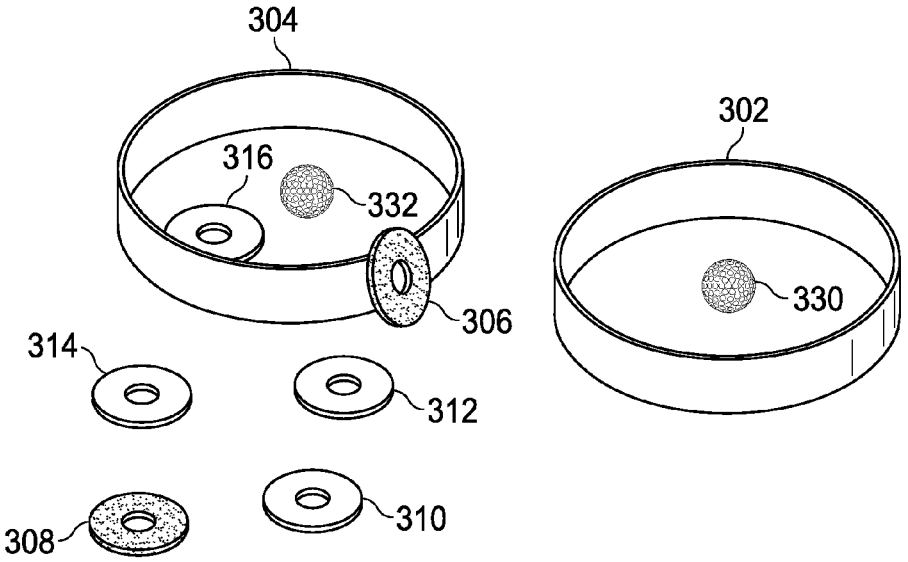
FIG. 3B is an illustration of an actual ring toss game in progress.

FIG. 3B is an illustration of an actual ring toss game in progress comprising the parts described in FIG. 3A comprising 2 metal rings 302 and 304, 2 metal tees with rubber tips 318 and 320, four locating stakes 322, 324, 326, and 328. There are also 2 balls 330 and 332. The discs comprise 2 silver number 1 discs: 310 and 312, 2 gold number 2 discs: 314 and 316, and 2 red number 3 discs: 306 and 308.

The present invention provides a carrying case (not shown) comprising the parts of the ring toss game of the present invention. The case comprises a top flap or a lid, which locks the case via a locking mechanism. The case has handles or straps for ease of carrying and transportation.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, MB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

REFERENCES

U.S. Pat. No. 4,936,590: Pitch Game.

U.S. Pat. No. 4,989,880: Tossing Game Apparatus.

U.S. Pat. No. 4,204,682: Method and Apparatus for Outdoor Tossing Game.

U.S. Pat. No. 4,203,592: Horseshoe Type Game Device.

U.S. Pat. No. 6,173,957: Tossing Game.

U.S. Pat. No. 6,341,780: Disc Tossing Game.

U.S. Pat. No. 6,669,200: Disc Toss Game.

What is claimed is:

1. A method of playing multiple ring toss games using a single game system comprising selecting to play a first ring toss game or a second ball capture game using a single game system comprising 2 metal rings, 4 stakes, 2 balls, and at least three sets of disc-type throwing projectiles, wherein each set of the at least three sets of disc-type throwing projectiles comprises at least 2 metal discs, wherein the discs are optionally colored or marked with a suitable indicia for identification;

wherein the first ring toss game comprises the steps of:

providing 2 metal rings, securing each of the metal rings are held in place on a surface by 2 stakes, wherein a first stake is placed on a front inside portion of the ring and a second stake is placed on a rear outside portion of the ring;

positioning one ball is placed at or about a center of each of the metal rings, wherein the ball may optionally be positioned on a top surface of a tee to be placed at or about the center of the metal ring;

placing the 2 metal rings approximately 25 ft. from each other;

allowing a first player to stand behind the metal rings;

tossing at least one of the at least one discs in a direction of the metal rings;

scoring points by one or any combination of the following:

throwing the disc and knocking the ball out of the ring to score 5 points;

throwing the disc and making it stay or lean inside the ring to score 5 points;

throwing the disc and making it lean on the outside of the ring or balance on the edge of the ring to score 3 points; and throwing the disc and having it land within 12" of the edge of the ring or the measurement of the largest player's shoe to score 1 point;

summing up the points scored to arrive at an accumulated score for each individual player, wherein an individual player may score a maximum of 15 points by throwing 2 discs into the ring while knocking the ball simultaneously out of the ring; and determining a winner of the first ring toss game by accumulating 21 points; and wherein the second ball capture game comprising the steps of:

providing a play area;

providing a gaming kit comprising:

using at least one ball;

using at least one set of a disc-type throwing projectiles, wherein each set of disc-type throwing projectiles comprise 2 discs; and throwing the ball within the play area, wherein the ball is thrown by a first player participating in the game;

allowing the first player to throw a disc to capture or get close to the ball;

allowing a second player to throw a disc to capture or get close to the ball;

allowing any subsequent player to throw a disc to capture or get close to the ball;

repeating the step of throwing a subsequent disc until the attempt of the first player has been bested;

accumulating points comprise one or any combination of the following:

throwing the disc and capturing the ball by being or landing on top of the ball in any manner to score 21 points;

throwing the disc and hitting the ball to score 5 points; and throwing the disc and landing within 6 inches of the ball to score 5 points;

throwing the disc and landing within 12 inches of the ball to score 3 points;

throwing the disc and landing within 24 inches of the ball to score 1 point; and summing up the points scored to arrive at an accumulated score for each individual player, wherein 10 points are deducted from the score of a player if the ball is on top of any part of the disc; and determining a winner of the second ball capture game by selecting the first player to accumulate 21 points.

2. The method of claim 1, wherein the surface on which the metal rings are placed comprises a grass surface, an artificial turf, a sandy surface, a court comprising a vinyl edging, or any combination thereof and wherein the court comprising a edging with a diameter of approximately 72".

3. The method of claim 1, wherein each set of disc-type throwing projectiles comprises a specific and distinguishable indicia or a combination thereof selected from a different color, shape, size, and number.

4. The method of claim 1, wherein the number of players range from 2-6 split into three teams of 2 players on each team, and each team receives a set of discs with a different color and a different numbering or indicia.

5. The method of claim 1, wherein the ring tossing game may be played indoors or outdoors.

* * * * *